US005572922A

United States Patent [19]

Moon

[11] Patent Number: 5,572,922

[45] Date of Patent: Nov. 12, 1996

[54] ACTUATING PLUNGER OF AN ELECTROMAGNETIC PUMP

[75] Inventor: Sung-Dai Moon, Kyeongsangbuk-do, Rep. of Korea

[73] Assignee: Daewoo Electronics Co., Ltd., Seoul, Rep. of Korea

[21] Appl. No.: 493,286

[22] Filed: Jun. 21, 1995

[30] Foreign Application Priority Data

Nov. 16, 1994 [KR] Rep. of Korea ..... 94-30019

[51] Int. Cl.[6] ..... F01B 31/00

[52] U.S. Cl. ..... 92/181 P; 92/158; 417/416

[58] Field of Search ..... 417/416, 417; 92/165 R, 181, 181 P, 158

[56] References Cited

U.S. PATENT DOCUMENTS 4,255,193 3/1981 Slesar et al. ..... 75/206

4,308,475 12/1981 Haeck ..... 417/417

4,376,618 3/1983 Toyoda et al. ..... 417/417

4,558,715 12/1985 Walton et al. ..... 137/99

*Primary Examiner*—Thomas E. Denion

*Attorney, Agent, or Firm*—Fish & Richardson P.C.

[57] ABSTRACT

Disclosed is an actuating plunger of an electromagnetic pump, the actuating plunger having a good magnetic characteristic so as to improve the operational efficiency of the electromagnetic pump and reduce the vibration and the operational noise due to the actuating plunger. The actuating plunger has a plunger head made by a high-temperature sintering. The plunger head has a cylindrical side wall, and a plurality of shoulders protruding inwards from a lower end of the cylindrical side wall. A piston is fixedly fitted in the middle of the shoulders. The piston extends downwards so as to be slidably fitted in a second cylinder.

10 Claims, 3 Drawing Sheets

ACTUATING PLUNGER OF AN ELECTROMAGNETIC PUMP

BACKGROUND OF THE INVENTION

1. Field of the Invention

The present invention relates to an actuating plunger of an electromagnetic pump, and more particularly to an actuating plunger which can be easily manufactured, and by which the operational efficiency of the electromagnetic pump can be improved and the operational. noise thereof can be reduced.

2. Prior Arts

An electromagnetic pump is an appliance for supplying fluid, and is generally used for supplying oil to a burner in a boiler system.

An electromagnetic pump has an actuating plunger alternating up and down in a hollow cylinder by an electromagnetic force so as to pressurize the oil.

FIG. 4 shows a conventional actuating plunger 250 as described above. Conventional actuating plunger 250 has a plunger head 251 and a piston 252.

FIGS. 5A and 5B are respectively a side sectional view and a plan view of plunger head 251. As shown, plunger head 251 has a cylindrical wall 253, and a bottom portion 254 formed integrally with the lower circular end of cylindrical wall 253.

Bottom portion 254 has a center hole 255, and four connecting holes 256 disposed around center hole 255 which are spaced apart from each other at regular circumferential intervals. Piston 252 is fixed in center hole 255. The space above and the space below plunger head 251 are interconnected to each other through connecting holes 256.

Actuating plunger 250 having the above construction moves up and down at a high speed by means of the electromagnetic force intermittently applied to a magnetic core by a solenoid, the magnetic core being disposed above the actuating plunger, so that the oil passing through the space under piston 252 is pressurized.

While actuating plunger 250 is moving up and down at a high speed, the oil in the space above piston 252 flows between the space above and the space below plunger head 251 through connecting holes 256. In this case, the oil provides a damping force for an up-and-down movement of actuating plunger 250. That is, the up-and-down movement of actuating plunger 250 is hindered by a viscous friction of the oil passing through connecting holes 256.

The larger the sectional area of the oil path or connecting holes 256 becomes, the less the damping force hindering the up-and-down movement of actuating plunger 250 becomes. The up-and-down movement of actuating plunger 250 is hindered relatively largely because the sectional area of connecting holes 256 is relatively small.

Meanwhile, when the conventional actuating plunger 250 of the electromagnetic pump as described above is manufactured, center hole 255 is first formed by cutting through the center of the bottom portion 254. as shown in FIG. 5A, and then four connecting holes 256 are formed around center hole 255 by the same cutting process in such a manner that four connecting holes 256 are spaced apart from each other at regular circumferential intervals. Then, piston 252 is inserted and fitted in center hole 255 so that the manufacturing process of actuating plunger 250 is completed.

Chips are produced during the cutting process of center hole 255 and connecting holes 256, and are not completely removed out of these holes while actuating plunger 250 is manufactured but remain in center hole 255 and connecting holes 256. The remaining chips may move together with oil so as to block the exhaust nozzle or to generate noise in operation of the electromagnetic pump.

Further, actuating plunger 250 may vibrate and generate noise during its movement, because a moment may be applied to plunger head 251 in the high-speed alternating movement of actuating plunger 250, when the center of gravity of plunger head 251 and the center of center hole 255 do not coincide with each other.

To prevent such vibration and noise, center hole 255 and connecting holes 256 should be formed in such a manner that the central axis of plunger head 251 and piston 252 is positioned at the centroid of a section of plunger head 251. That is, center hole 255 and connecting holes 256 should be complete circles, respectively and connecting holes 256 should be disposed along a circumference of a phantom circle concentric with center hole 255 and spaced apart from each other at regular circumferential intervals.

However, it is very difficult to cut through plunger head 251 to make center hole 255 and connecting holes 256 in order for the center of gravity of plunger head 251 and the center of center hole 255 to coincide with each other as described above.

Moreover, actuating plunger 250 must have a good magnetic characteristic of ensuring smooth up-and-down movement of actuating plunger 250 by means of the solenoid, and thereby actuating plunger should preferably be made from ferrite iron having a good magnetic characteristic. However, it is difficult to cut the ferrite iron, and the systematic structure of the ferrite iron can be changed and its magnetic characteristic can deteriorate due to heat generated during its cutting process and to cooling conditions after the cutting.

Therefore, generally the conventional actuating plunger 250 of an electromagnetic pump has been made from an alloy comprised of iron (Fe), silicon (Si), manganese (Mn), carbon (C), phosphorus (P), sulfur (S), and lead (Pb) instead of the ferrite iron. The alloy has inferior magnetic characteristic but superior cutting characteristic and resistance-to-heat compared to the ferrite iron.

As described above, conventional actuating plunger 250 has disadvantages that chips are produced in its cutting process, that the removal of the chips is very difficult, and that the chips can block the exhaust nozzle or generate noise. Moreover, the conventional actuating plunger can not be made from ferrite iron having good magnetic characteristic due to the restriction in relation to its cutting. The conventional actuating plunger exhibits low efficiency in utilizing energy because its up-and-down movement is hindered relatively largely by a viscous resistance of oil. In addition, it is difficult to cut through plunger head 251 to make center hole 255 and connecting holes 256 in such a manner to prevent a moment from being applied to plunger head 251 in its operation.

SUMMARY OF THE INVENTION

The present invention has been made to overcome the above described problems of the prior art, and accordingly it is an object of the present invention to provide an actuating plunger of an electromagnetic pump. The actuating plunger has a good magnetic characteristic so as to improve the operational efficiency of the to electromagnetic pump and reduce the vibration and the operational noise due to the actuating plunger.

To achieve the above object, the present invention provides an actuating plunger of an electromagnetic pump including a first cylinder, a second cylinder fixed at a lower end of the first cylinder, and an actuating plunger moving up and down in the first cylinder so as to pressurize oil and supply the oil into the first cylinder, the oil being exhausted from the first cylinder, the actuating plunger comprising:

a plunger head manufactured according to a high-temperature sintering by utilizing a die, the plunger head including a cylindrical side wall, and a plurality of shoulders protruding inwards from a lower end of the cylindrical side wall, the shoulders being formed integrally with the cylindrical side wall, the shoulders being spaced apart from each other at regular circumferential intervals and having inner surfaces, each of the inner surfaces being rounded, the inner surfaces constituting portions of a phantom cylinder concentric with the! cylindrical side wall, so that a distance from the cylindrical side wall to each of the inner surfaces is equal to each other, and that the plunger head has a plurality of oil paths defined between each adjacent pair of the shoulders through the plunger head, the oil paths having a shape of a fan; and a piston fixedly fitted in the middle of the shoulders and extending downwards from the plunger head, the piston being in close contact with the inner surfaces, the piston slidably fitted in the second cylinder, the oil flowing through the oil paths between a first space above the plunger head and a second space under the plunger head when the actuating plunger moves up and down.

When the actuating plunger alternates up and down at a very high speed, the damping force to the movement of the actuating plunger provided by the oil in the first cylinder is greatly reduced as compared with that of the conventional actuating plunger.

In manufacturing the actuating plunger of the present invention, the plunger head can be manufactured without a cutting process by high-temperature sintering by means of a die, and thereby its manufacture is relatively easy and its manufacturing cost is reduced.

Moreover, the actuating plunger can be made from pure iron or an alloy nearly equal to pure iron having a good magnetic characteristic since the cutting process is not necessary.

BRIEF DESCRIPTION OF THE DRAWINGS

The above object, and other advantages and features of the present invention will become more apparent by describing preferred embodiments thereof in detail with reference to the attached drawings, in which.

DESCRIPTION OF THE PREFERRED EMBODIMENTS

Hereinafter, several preferred embodiments of the present invention will be described in detail with reference to the accompanying drawings.

Figure 1:
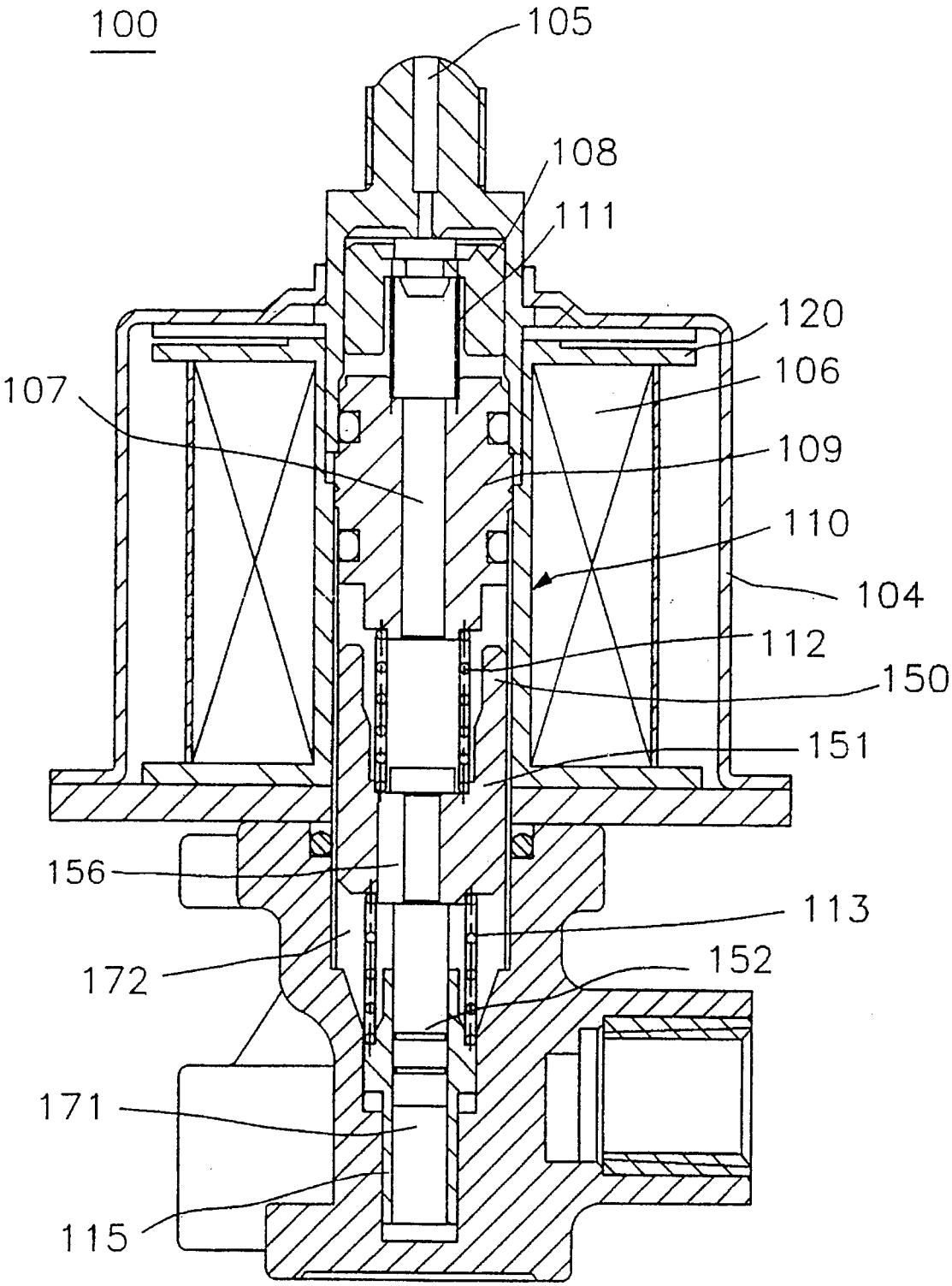
FIG. 1 is a sectional view of an electromagnetic pump having an actuating plunger according to an embodiment of the present invention.

FIG. 1 is a sectional view of an electromagnetic pump 100 having an actuating plunger according to an embodiment of the present invention. Electromagnetic pump 100 has a first hollow cylinder 110. First cylinder 110 has a bobbin 120 on which a solenoid 106 is wound.

A second hollow cylinder 115 is fixed at the lower end of first cylinder 110. Bobbin 120 encircles a magnetic core 109 to be fixed therein, and an actuating plunger 150 is so disposed under magnetic core 109 in first cylinder 110 as to be movable up and down in first cylinder 110.

Figure 2:
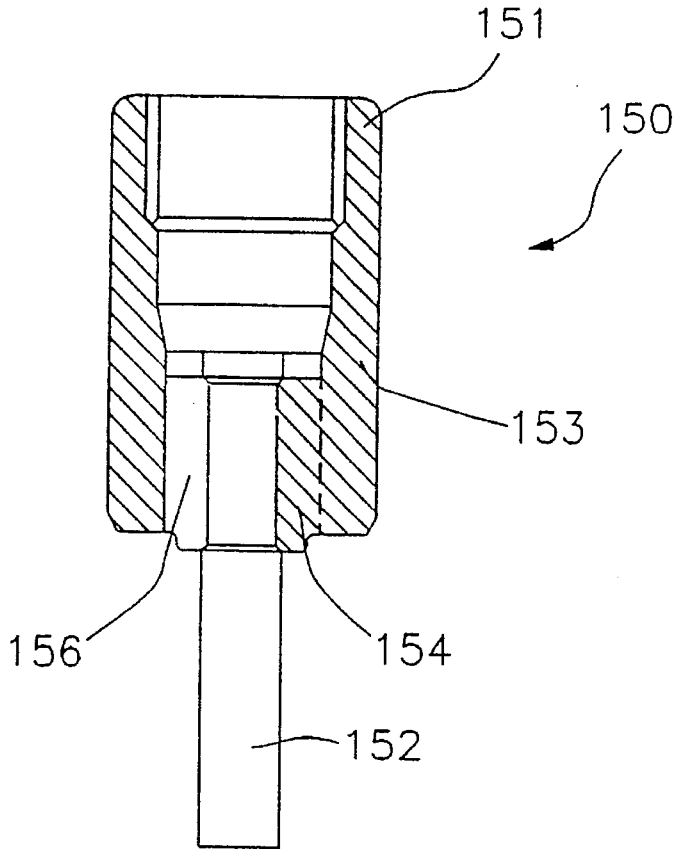
FIG. 2 is a sectional view of the actuating plunger shown in FIG. 1.

FIG. 2 shows a side sectional view of actuating plunger 150. Actuating plunger 150 has a plunger head 151, and a piston 152 fixed at the bottom center of plunger head 151 and extending downwards. Piston 152 is slidably fitted in second cylinder 115.

Referring again to FIG. 1, a first space 171 and a second space 172 are respectively defined above and under second cylinder 115. First space and second space 171 and 172 being separated from each other by piston 152.

A first spring 112 is installed between magnetic core 109 and plunger head 151, and a second spring 113 is installed between plunger head 151 and piston 152. An exhaust valve 108 is installed above magnetic core 109 and supported by third spring 111.

Further, a suction check valve and an exhaust check valve (not shown) are provided at the opposite ends of first space 171 which is interconnected to second space 172 through the exhaust check valve.

Figure 3A:
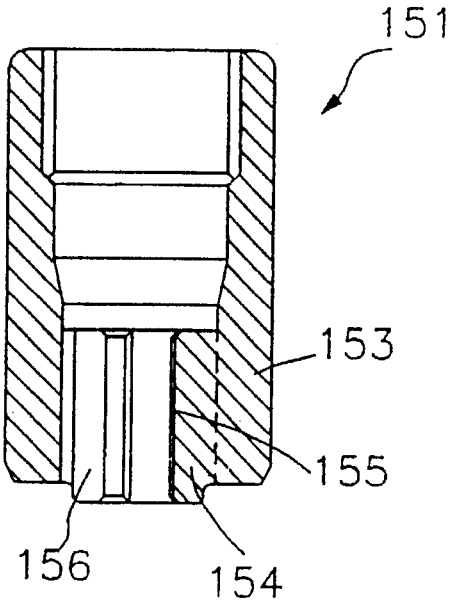
FIGS. 3A and 3B are a side sectional view and a plan view of the plunger head of the actuating plunger,respectively shown in FIG. 2.
Figure 3B:
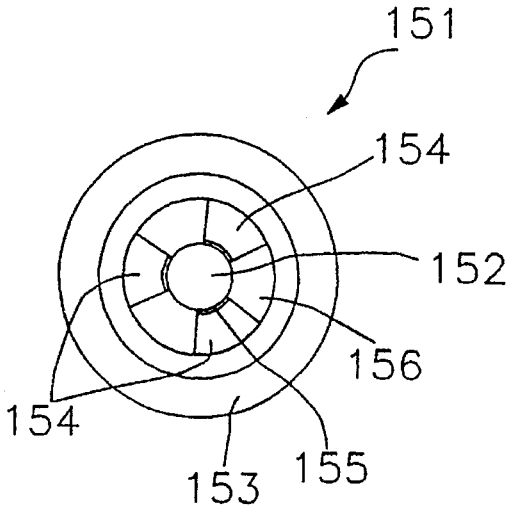
Figure 4:
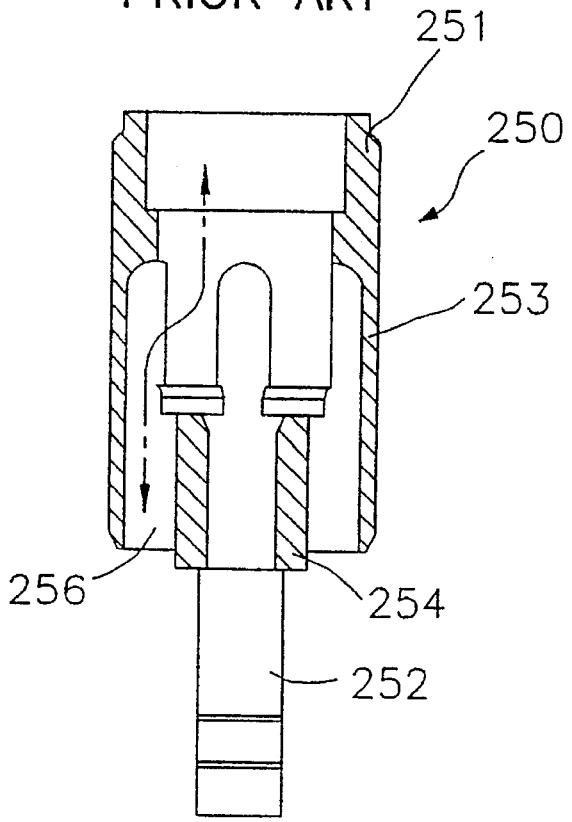
FIG. 4 PRIOR ART
FIG. 4 is a sectional view of a conventional actuating plunger.
Figure 5A:
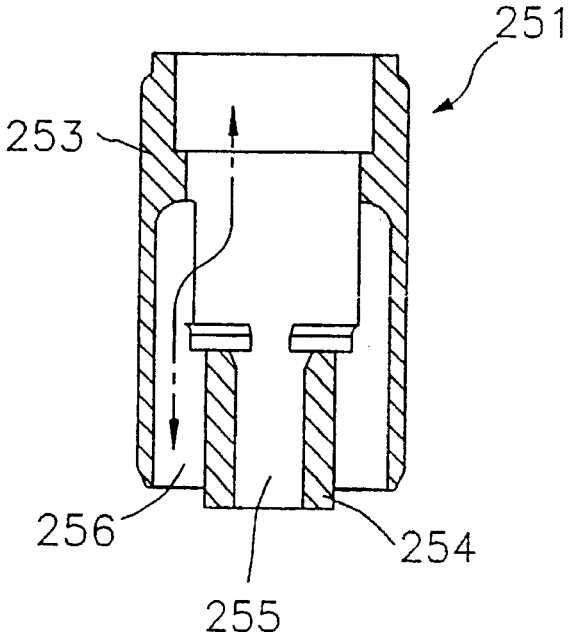
FIG. 5A PRIOR ART
FIGS. 5A and 5B are a side sectional view and a plan view of the plunger head of the actuating plunger respectively shown in FIG. 4.
Figure 5B:
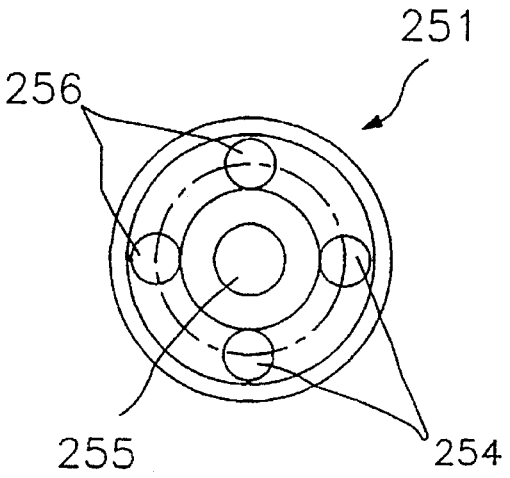
FIG. 5B PRIOR ART

FIGS. 3A and 3B are a side sectional view and a plan view of plunger head 151. Plunger head 151, respectively has a cylindrical side wall 153, and three shoulders 154 formed integral with cylindrical side wall 153 and protruding inward from the lower end of cylindrical side wall 153.

The inner surfaces of shoulders 154 are rounded and constitute portions of a phantom cylinder concentric with cylindrical side wall 153. In other words, the inward heights of shoulders 154, or the distances from cylindrical side wall 153 to the inner surfaces of shoulders 154 are equal to each other.

Shoulders 154 are spaced apart from each other at regular circumferential intervals, and thereby oil paths 156 of fan shape are formed between in actuating plunger 150.

The operation of the electromagnetic pump having the above described construction will be described hereinbelow.

First, actuating plunger 150 moves up toward magnetic core 109 by means of a magnetization of magnetic core 109 when electric power is applied to solenoid 106. At that time, first space 171 under piston 152 is upwardly expanded longer, and the suction check valve is opened and the exhaust check valve is closed, so that oil is introduced from an oil tank (not shown) into first space 171.

Then, the electric power having been applied to solenoid 106 is interrupted to thereby actuating plunger 150 downwards by a downwardly biasing force of first spring 112. In this case, second spring 113 prevents actuating plunger 150 from moving downwards too far from magnetic core 109 so as to maintain actuating plunger 150 in the range in which the electromagnetic force of magnetic core 109 is applicable.

As actuating plunger 150 is downwardly moved by first spring 112, the volume of first space 171 under piston 152 is reduced so that a pressure on the oil therein is increased. Accordingly, the suction check valve is closed and the exhaust check valve is opened, while the oil pressurized in first space 171 flows through the exhaust check valve into second space 172 above piston 152. Then, the pressurized oil is exhausted from second space 172 through a central oil path 107 defined through magnetic core 109, exhaust valve 108, and an exhaust nozzle 105.

The up-and-down movement of actuating plunger 150 as described above is periodically repeated because a half-wave rectified alternating current is applied to solenoid 106. The repetitive alternating movement of actuating plunger 150 is very fast because the electric power applied to the electromagnetic pump generally has a high frequency of 60 Hz or more. According to the up-and-down movement of plunger head 151 in second space 172 naturally accompanying the up-and-down movement of actuating plunger 150, the oil in second space 172 flows to and from between either side of plunger head 151 through oil paths 156.

In this case, the damping force to the up-and-down movement of actuating plunger 150 provided by the oil in second space 172 in the present invention is much smaller than that of the up-and-down movement of conventional actuating plunger 250 since the sectional area of oil paths 156 is much larger than that of connecting holes 256 of conventional actuating plunger 250.

In manufacturing actuating plunger 150 according to an embodiment of the present invention as described above, plunger head 151 can be manufactured without a cutting process by high-temperature sintering by means of a die (not shown) having a concave shape complementary to the shape of plunger head 151, and thereby its manufacture is relatively easy and its manufacturing cost is reduced.

Moreover, actuating plunger 150 can be made from pure iron or an alloy nearly equal to pure iron having a good magnetic characteristic since the cutting process is not necessary.

Hereinafter, an example of a process for manufacturing actuating plunger 150 according to the present invention as described above will be briefly described.

EXAMPLE

Composition of a raw material:

Fe,97–99.7% by weight; Cr, 0.2–2.8% by weight; Ni, 0.1%by weight; Si, 0.1% by weight.

At first, powder having the above composition is mixed with a usual lubricator for sintering. Then, a portion of the mixed powder is filled in a prefabricated die in which a core has a concave shape complementary to the shape of plunger head 151, and is compressed with a pressure of 7–10 ton/cm$^2$ at the normal temperature by a press. In this case, a precise design of the core and its shape is desired for a precise formation of plunger head 151.

Next, the conglomerated powder by the compression at the normal temperature is heated to and maintained at a high temperature just below a melting point, so as to cause its metal particles to be diffusion-bonded and thereby an alloy is produced. Then, the alloy is put in the die and compressed again to correct errors in size.

And then, the alloy is exposed to a superheated steam at 450–550 degrees centigrade to cause layers of black iron oxide $Fe_3O_3$ to be coated on and be produced in the alloy so as to improve the corrosion-resistance and the air-tightness of the alloy. After that, the alloy is gas-carburized to elevate its surface hardness and thereby improve its abrasion-resistance and its fatigue strength.

At last, the alloy is cooled slowly at 175 degrees centigrade so that the internal stress of the alloy is removed and the magnetic characteristic of the alloy is improved.

According to the present invention as described above, plunger head 151 is manufactured according to a high-temperature sintering by utilizing the prefabricated die without a cutting process. Therefore, plunger head 151 can be made from pure iron or nearly pure iron so as to have a superior magnetic characteristic and a superior mechanical characteristic compared with conventional plunger head 251 manufactured by cutting process, and accordingly a coarse surface in plunger head 151 or chips due to the cutting process are not produced. In addition, the manufacturing process is simplified and the manufacturing cost is reduced, and actuating plunger 150 having the same quality and the same shape can be mass-produced at such low cost.

Moreover, according to the present invention, the damping force to the up-and-down movement of actuating plunger 150 is greatly reduced and the operational efficiency of actuating plunger 150 is greatly improved. Further, clogging of the exhaust nozzle or noise due to the chips remaining in plunger head 151 after manufacture is prevented from happening since chips are not produced in the manufacture of the actuating plunger. Furthermore, it is easy to make the center of gravity of plunger head 251 and the center of center hole 255 coincide with each other, and thereby vibration and noise which could be generated due to discord of the two centers are prevented in the operation of actuating plunger 150.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. An electromagnetic pump including a first cylinder, a second cylinder fixed at a lower end of the first cylinder, and an actuating plunger moving up and down in the first cylinder so as to pressurize oil and supply the oil into the first cylinder, the oil being exhausted from the first cylinder, the actuating plunger comprising:

a plunger head having a cylindrical side wall and a plurality of shoulders protruding inwards from a lower end of the cylindrical side wall; and a piston fixed to the plunger head and extending downwards from the plunger head to be slidably fitted in the second cylinder, wherein the piston fixed to the plunger head, the plurality of shoulders and the cylindrical side wall defines a plurality of oil paths, and the oil flows between a first space above the plunger head and a second space under the plunger head through the plurality of oil paths when the actuating plunger moves up and down.

2. The electromagnetic pump as claimed in claim 1, wherein the plurality of shoulders are formed integrally with the cylindrical side wall and the piston is fixedly fitted in the middle of the plurality of shoulders.

3. The electromagnetic pump as claimed in claim 2, wherein the plurality of shoulders are spaced apart from each other at regular circumferential intervals and include inner surfaces each of which is rounded to constitute portions of a phantom cylinder concentric with the cylindrical side wall, and a distance from the cylindrical side wall to each of the inner surfaces is equal to each other.

4. The electromagnetic pump as claimed in claim 3, wherein the piston is in close contact with the inner surfaces.

5. The electromagnetic pump as claimed in claim 1, wherein the plurality of oil paths are spaced apart from each other at regular circumferential intervals.

6. The electromagnetic pump as claimed in claim 1, wherein the plunger head is comprised of an alloy consisting of iron of 97–99.7% by weight, chrome of 0.2–2.8% by weight, nickel of 0.1% by weight, and silicon of 0.1% by weight.

7. The electromagnetic pump as claimed in claim 1, wherein the plunger head is manufactured according to a high temperature sintering by utilizing a die.

8. An electromagnetic pump including a first cylinder, a second cylinder fixed at a lower end of the first cylinder, and an actuating plunger moving up and down in the first cylinder so as to pressurize oil and supply the oil into the first cylinder, the oil being exhausted from the first cylinder, the actuating plunger comprising:

a plunger head including a cylindrical side wall and a plurality of shoulders protruding inwards from a lower end of the cylindrical side wall, the plurality of shoulders being formed integrally with the cylindrical side wall, where the plurality of shoulders are spaced apart from each other at regular circumferential intervals and have inner surfaces each of which is rounded to constitute portions of a phantom cylinder concentric with the cylindrical side wall, wherein a distance from the cylindrical side wall to each of the inner surface is equal to each other; and a piston fixedly fitted in close contact with the middle of the inner surfaces of the plurality of shoulders and extending downwards from the plunger head to be slidably fitted in the second cylinder, wherein the piston fixed to the plunger head, the plurality of shoulders and the cylindrical side wall defines a plurality of oil paths, and the oil flows between a first space above the plunger head and a second space under the plunger head through the plurality of oil paths when the actuating plunger moves up and down.

9. The electromagnetic pump as claimed in claim 8, wherein the plunger head is comprised of an alloy consisting of iron of 97–99.7% by weight, chrome of 0.2–2.8% by weight, nickel of 0.1% by weight, and silicon of 0.1% by weight.

10. The electromagnetic pump as claimed in claim 8, wherein the plunger head is manufactured according to a high temperature sintering by utilizing a die.

* * * * *